US008421792B2

(12) United States Patent
Chung

(10) Patent No.: US 8,421,792 B2
(45) Date of Patent: Apr. 16, 2013

(54) DATA TRANSMITTING DEVICE AND FLAT PLATE DISPLAY USING THE SAME

(75) Inventor: Jin-Won Chung, Goyang-si (KR)

(73) Assignee: LG Display Co., Ltd., Seoul (KR)

( * ) Notice: Subject to any disclaimer, the term of this patent is extended or adjusted under 35 U.S.C. 154(b) by 316 days.

(21) Appl. No.: 12/845,213

(22) Filed: Jul. 28, 2010

(65) Prior Publication Data

US 2011/0157142 A1 Jun. 30, 2011

(30) Foreign Application Priority Data

Dec. 30, 2009 (KR) ..... 10-2009-0133956

(51) Int. Cl.
*G09G 5/00* (2006.01)

(52) U.S. Cl.
USPC ..... 345/212; 345/98; 345/204

(58) Field of Classification Search ..... 345/76, 345/82, 87, 98–100, 204, 212
See application file for complete search history.

(56) References Cited

U.S. PATENT DOCUMENTS 5,627,457 A * 5/1997 Ishiyama et al. ..... 323/318
6,828,950 B2 * 12/2004 Koyama ..... 345/76
7,193,623 B2 3/2007 Moon
2004/0239696 A1 * 12/2004 Okabe et al. ..... 345/690
2006/0125757 A1 6/2006 Kang et al.
2007/0063739 A1 3/2007 Kim
2009/0073157 A1 3/2009 Lin
2010/0045655 A1 * 2/2010 Jang ..... 345/213
2010/0188067 A1 * 7/2010 Chang et al. ..... 323/313

FOREIGN PATENT DOCUMENTS

CN 101193217 A 6/2008
WO WO 2005/043769 A1 5/2005

* cited by examiner

*Primary Examiner* — Regina Liang
(74) *Attorney, Agent, or Firm* — McKenna Long & Aldridge, LLP

(57) ABSTRACT

A data transmitting device and a flat plate display using the same are disclosed. The data transmitting device includes a current generator comprising a plurality of constant current sources connected in parallel and a plurality of switches connected to output terminals of the constant current sources, respectively, the current generator configured to switch the switches independently according to a preset digital current control signal and adding up the currents supplied from the constant current sources via the tuned-on switches to output; a current amplifier configured to amplify and output the output current of the current generator; and a line driver configured to generate and output a low voltage differential signal according to input data by using a constant current such as the amplified current of the current amplifier.

11 Claims, 3 Drawing Sheets

DATA TRANSMITTING DEVICE AND FLAT PLATE DISPLAY USING THE SAME

CROSS REFERENCE TO RELATED APPLICATION

This application claims the benefit of the Patent Korean Application No. 10-2009-0133956, filed on Dec. 30, 2009, which is hereby incorporated by reference as if fully set forth herein.

BACKGROUND OF THE INVENTION

1. Field of the Invention

The present invention relates to a data transmitting device, more particularly, to a data transmitting device capable of controlling amplitude of a differential signal stably, with removing an option pin and variable resistance to control amplitude of a low voltage differential signal, and a flat plate display using the same.

2. Discussion of the Related Art

A flat plate display capable of displaying images by using digital data may include a liquid crystal display (LCD) using liquid crystal, a plasma display panel (PDP) using discharge of inactive gas, an organic light emitting diode (OLED) display using organic light emitting diodes and the like.

Because of a trend of high resolution and large size required to display a high quality image, the amount of data transmission of such the flat plate panel display device has been increasing. As a result, the transmission frequency of data is getting high and the number of data transmission lines is increased such that electromagnetic interference (hereinafter, EMI) may occur a lot. The problem of EMI is generated in digital interface between a timing controller and a data driver of the flat plate display and it causes unstable driving of the device. To solve the problem of EMI and to reduce power consumption when data is transmitted at a high speed, the flat plate display uses data transmission methods that transmit data by using low voltage differential signals, wherein the data transmission methods includes an LVDS (Low Voltage Differential Signal) transmission method, a Mini-SVDS transmission method and the like. The interface between the timing controller and the data driver of the flat plate display typically uses the mini-LVDS data transmission method.

For the mini-LVDS data transmission, the timing controller includes an LVDS transmitter mounted in an output terminal and the data driver includes an LVDS receiver mounted in an input terminal. The LVDS transmitter converts data into a low voltage differential signal and it transmits the low voltage differential signal serially by using a couple of transmission lines. The LVDS receiver detects a voltage difference at termination resistance between the transmission couple of the lines and it restores data. The LVDS transmitter, the LVDS receiver and the couple of the transmission lines between them may form a current loop. An output voltage of the LVDS transmitter is determined by a reference voltage of a reference voltage generator. In other words, the output voltage of the LVDS transmitter may be controllable according to the control of the reference voltage. The timing controller IC (Integrated Circuit) of the related art integratedly having the LVDS transmitter mounted therein may include an option pin (RMLVDS) connected with the reference voltage generator and a variable resistance mounted on PCB (Printed Circuit Board) for a designer to control the reference voltage, that is, output voltage of the timing controller IC outside.

However, the variable resistance has to be mounted outside the timing controller IC additionally, only to cause work inconvenience and the option pin (RMLVDS) connected with the variable resistance has to be provided no matter what. Because of that, it is limited to reduce the number of pins and to reduce the production cost of the timing controller IC. Also, if the option pin (RMLVDS) is floated because of contact failure of the external variable resistance, it is impossible to generate the reference current and to generate to the output voltage accordingly. Because of that, the timing controller IC might be evaluated operation-failure.

SUMMARY OF THE INVENTION

Accordingly, the present invention is directed to a data transmitting device and a flat plate display using the same.

An object of the present invention is to provide a data transmitting device capable of removing an option pin and a variable resistance for controlling amplitude of a low voltage differential signal, with controlling the amplitude stably, and a flat plate display using the data transmitting device.

Additional advantages, objects, and features of the disclosure will be set forth in part in the description which follows and in part will become apparent to those having ordinary skill in the art upon examination of the following or may be learned from practice of the invention. The objectives and other advantages of the invention may be realized and attained by the structure particularly pointed out in the written description and claims hereof as well as the appended drawings.

To achieve these objects and other advantages and in accordance with the purpose of the invention, as embodied and broadly described herein, a data transmitting device includes a current generator comprising a plurality of constant current sources connected in parallel and a plurality of switches connected to output terminals of the constant current sources, respectively, the current generator configured to switch the switches independently according to a preset digital current control signal and adding up the currents supplied from the constant current sources via the tuned-on switches to output; a current amplifier configured to amplify and output the output current of the current generator; and a line driver configured to generate and output a low voltage differential signal according to input data by using a constant current such as the amplified current of the current amplifier.

The switches of the current generator may be connected commonly with a node having the currents added-up therein and the switches are switched independently in response to each bit of the current control signal, to control the current outputted from the current generator according to the current control signal.

The data transmitting device may further include a reference voltage generator configured to generate and output a reference voltage used as a reference when driving the line driver, the reference voltage generator further configured to generate and output a current added up to the output current of the current generator.

The swing of the low voltage differential signal outputted from the line driver may be determined based on the output current of the current generator controlled according to the current control signal.

The data transmitting device may further include a variable resistance connected with the reference voltage generator to control the output current of the reference voltage generator outside.

The swing of the low voltage differential signal outputted from the line driver may be controlled based on the control of at least one of the output current of the current generator and the output current of the reference voltage generator.

In another aspect of the present invention, a flat plate display comprising, the flat plate display includes a timing controller the data transmitting device disclosed above to convert image data into the low voltage differential signal and to output the converted low voltage differential signal; and a data driver configured to receive the low voltage differential signal from the timing controller and to restore and display the image data from the received differential signal.

The flat plate display may be a liquid crystal display or an organic light emitting diode display.

It is to be understood that both the foregoing general description and the following detailed description of the present invention are exemplary and explanatory and are intended to provide further explanation of the invention as claimed.

BRIEF DESCRIPTION OF THE DRAWINGS

The accompanying drawings, which are included to provide a further understanding of the disclosure and are incorporated in and constitute a part of this application, illustrate embodiment(s) of the disclosure and together with the description serve to explain the principle of the disclosure.

In the drawings.

DESCRIPTION OF THE ILLUSTRATED EMBODIMENTS

Reference will now be made in detail to the specific embodiments of the present invention, examples of which are illustrated in the accompanying drawings. Wherever possible, the same reference numbers will be used throughout the drawings to refer to the same or like parts.

Figure 1:
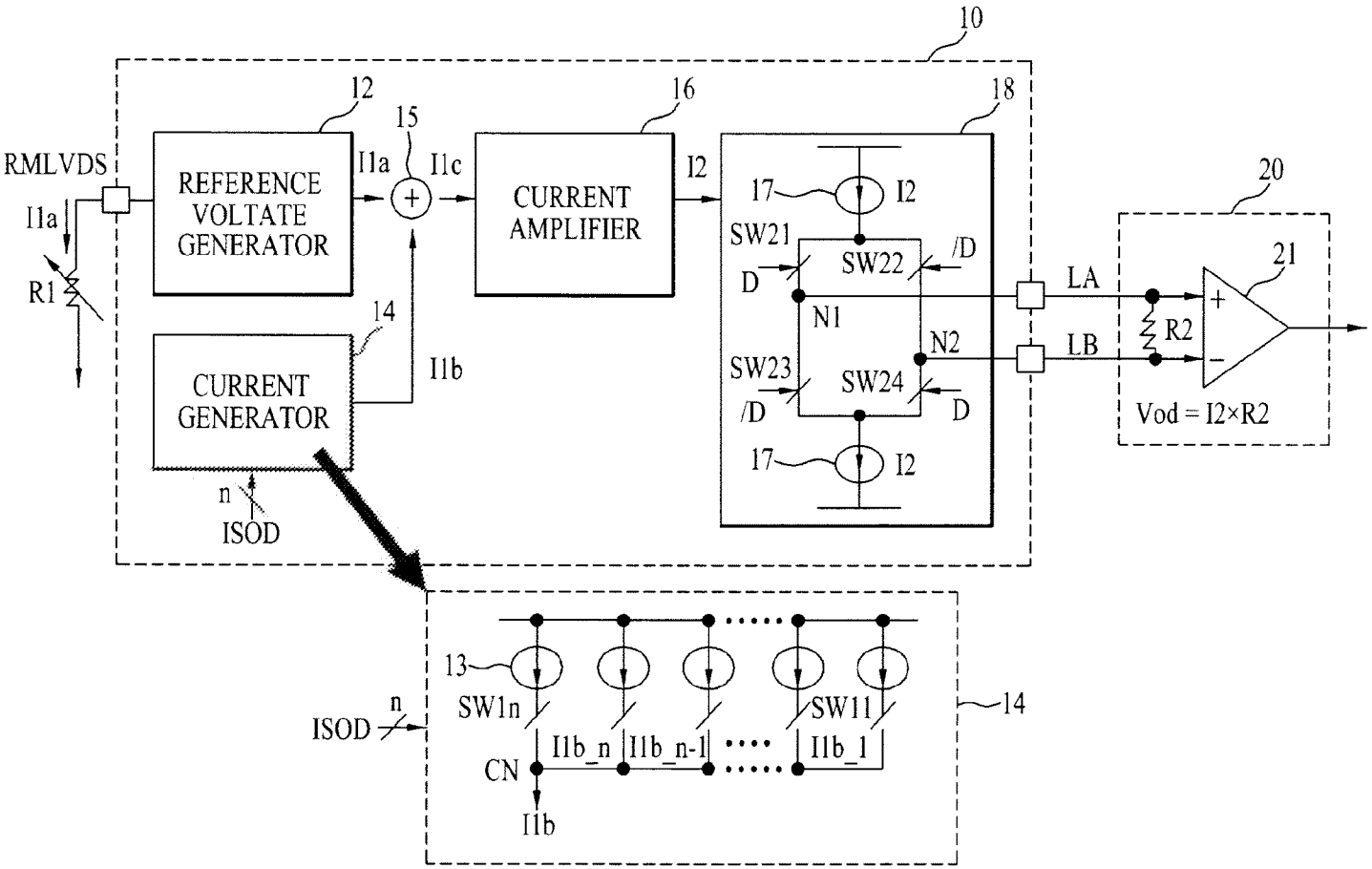
FIG. 1 is a diagram schematically illustrating a data transmitting device according to an exemplary embodiment of the present invention.

FIG. 1 is a circuit diagram schematically illustrating a data transmitting device according to an exemplary embodiment of the present invention, The data transmitting device shown in FIG. 1 includes an LVDS transmitter 10 and an LVDS receiver 20 to transmit data based on the mini-LVDS. The LVDS transmitter 10 includes a reference voltage generator 12, a current generator 14, a current amplifier 16 and a line driver 18. The LVDS receiver 20 includes a termination resistance (R2) and a comparator 21. The line driver 18 of the LVDS transmitter 10 and the termination resistance of the LVDS receiver 20 are connected with each other via a couple of transmission lines (LA and LB), to form a current loop.

The reference voltage generator 12 generates a reference voltage used as a reference when driving the couple of the transmission lines (LA and LB) of the line driver 18 and it outputs the generated reference voltage. In addition, the reference voltage generator 12 generates and outputs a first current I1*a* which is controllable according to resistance control of the variable resistance (R1) connected via the option pin (RMLVDS).

The current generator 14 generates and outputs a second current I1*b* according to a current control signal (ISOD). For that, the current generator 14 includes a plurality of, that is, 'n' constant current sources 13 connected in parallel and a plurality of, that is, 'n' switches (SW11~SWn) that switches currents (I1*b*_1~I1*b*_n) of the constant current sources controlled according to bits of the constant control signals (ISOD), respectively, to output the result of the switching to a common node (CN). The current generator 14 adds up the currents (I1*b*_1~I1*b*_n) supplied to the common node (CN) from the constant current sources 13 via the switches (SW11~SWn) turned on in response to the bits of the current control signals (ISOD) and it outputs the result of adding-up as the second current (I1*b*). The n-bit current control signals (ISOD) is preset by a designer and it is stored in an internal register, with updatable according to the designer's necessity. For example, if a 4-bit current control signal (ISOD) is preset as "1010", the current generator 14 includes four constant current sources 14 and four switches (SW11~SW14). two currents (Is2_*b* and I1*b*_4) are supplied to the common nodes (CN) from each of the constant current sources 13 via the second and fourth switches (SW12 and SW14) turned on according to "1010" and the two currents (I1*b*_2 and I1*b*_4) supplied to the common node (CN) are added up to be outputted as the second current (I1*b*).

The first current (I1*a*) outputted from the reference voltage generator 12 and the second current (I1*b*) outputted from the current generator 14 are added up via a contact node 15 and the added current (I1*c*) is supplied to the current amplifier 16. The current amplifier 16 amplifies the input added current (I1*c*) and it supplies the amplified current I2 to the line driver 18.

The line driver 18 includes input/output constant current sources 17 and four switches (SW21~SW24). The input/output constant current source 17 generates an identical constant current I2 to the amplified current I2 supplied from the current amplifier 16. the fourth switches (SW21~SW24) are connected between the input and output constant current sources 17 to form a current loop together with the couple of the transmission lines (LA and LB) and the termination resistance (R2) and they are switched according to the input data (D and /D) to output a differential signal. The line driver 18 supplies a positive or negative constant current (I2) to the couple of the transmission lines (LA and LB) based on the selective turning-on and off of the four switches (SW21~SW24) according to the serial data (D and /D), such that positive or negative voltages (Vod) may be generated in both terminals of the termination resistance (R2). For example, when high-level data (D) is inputted, two switches (SW21 and SW24) are turned on and a positive (+) constant current (I2) flows via the couple of the transmission lines (LA and LB) and the termination resistance (R2), only to generate a positive (+) voltage (Vod=I2×R2) at the both terminals of the termination resistance (R2). If low-level data (D) is inputted, two switches (SW22 and SW23) are turned on and a negative (−) constant current I2 flows via the couple of the transmission lines (LA and LB) and the termination resistance (R2), only to generate a negative (−) voltage (Vod=I2×R2) at the both terminals of the termination resistance (R2).

The LVDS receiver 20 detects a voltage (Vod) at the termination resistance (R2) by using the comparator 21 and it restores high-level or low-level data.

As mentioned above, the data transmitting device based on mini-LVDS controls at least one of the first current (I1*a*) of the reference voltage generator 12 and the second current (I1*b*) of the current generator 14 to control the output current (I2) of the line driver 18, such that it may control the swing of the output voltage (Vod), that is, the swing of the low voltage differential signal.

Furthermore, the data transmitting device based on mini-LVDS controls currents in a dual-mode. As a result, even if the first current (I1*a*) is not generated from the reference voltage generator 12 because of contact error of the variable resistance (R1), the line driver may generate and output a differential signal by using the second current (I1*b*) generated from the current generator 14. In addition, the data transmitting device based on the mini-LVDS controls the current control signal (ISOD) to control the output current (I2) of the line driver 18. As a result, the amplitude of the output voltage (Vod) may be controlled.

Figure 2:
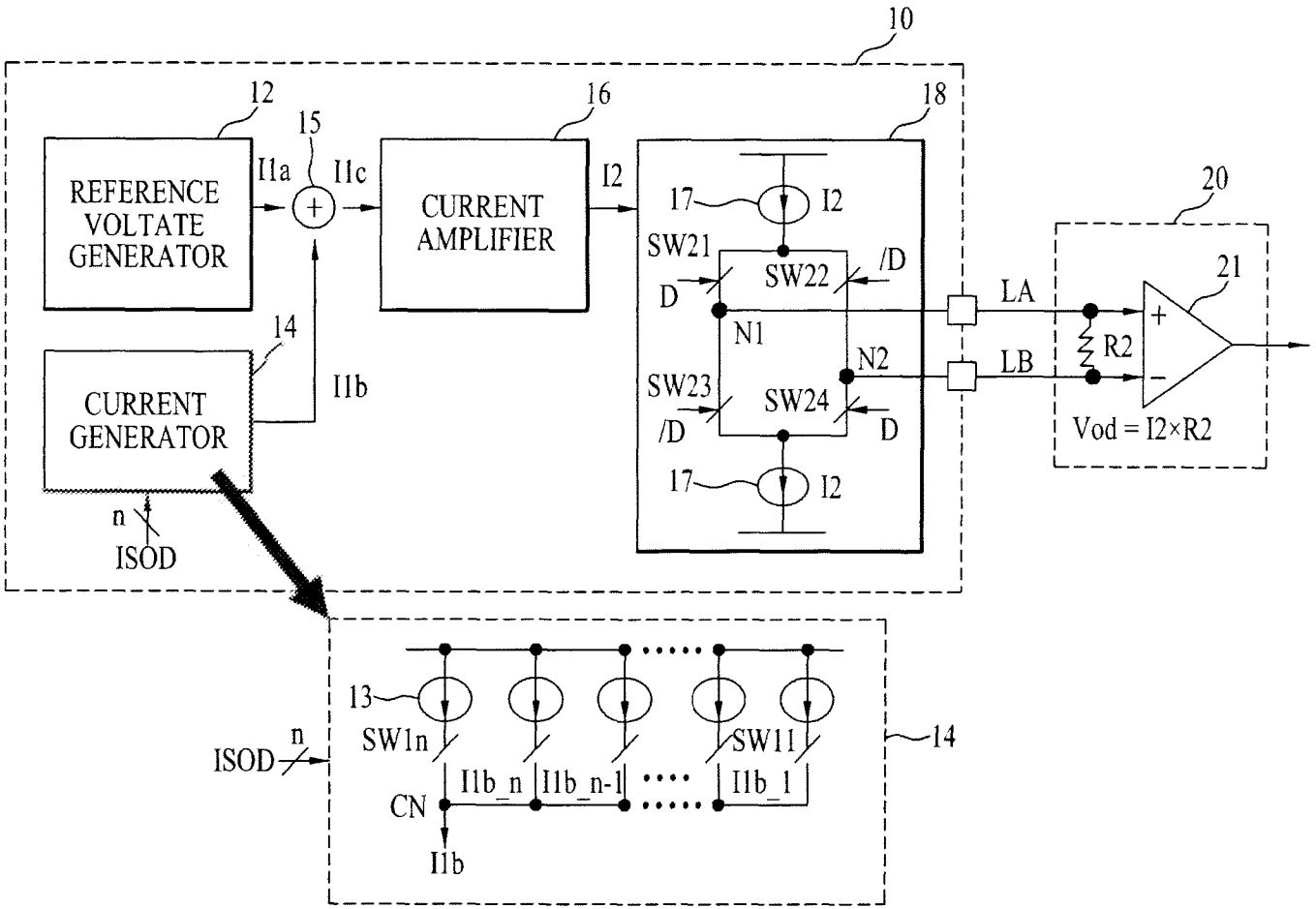
FIG. 2 is a circuit diagram schematically illustrating a data transmitting device according to another embodiment of the present invention.

Therefore, the data transmitting device as shown in FIG. 2 may remove the option pin (RMLVDS) connected with the reference voltage generator 12 and the variable resistance (R1).

Since the option pin (RMLVDS) and the variable resistance (R1) are removed as shown in FIG. 2, the first current (I1*a*) generated from the reference voltage generator 12 may not be controlled outside but the n-bit current control signal (ISOD) inputted to the current generator 14 may be controlled to control the second current (I1*b*). Because of that, the second current (I1*b*) of the current generator 14 shown in FIG. 2 may be controlled and the output current (I2) of the line driver 18 may be controlled accordingly, such that the amplitude of the output voltage (Vod) may be controllable also. As a result, the option pin (RMLVD) and the variable resistance (R1) are removed from the timing controller IC having the LVDS transmitter 10 mounted therein and the production cost may be reduced accordingly.

Figure 3:
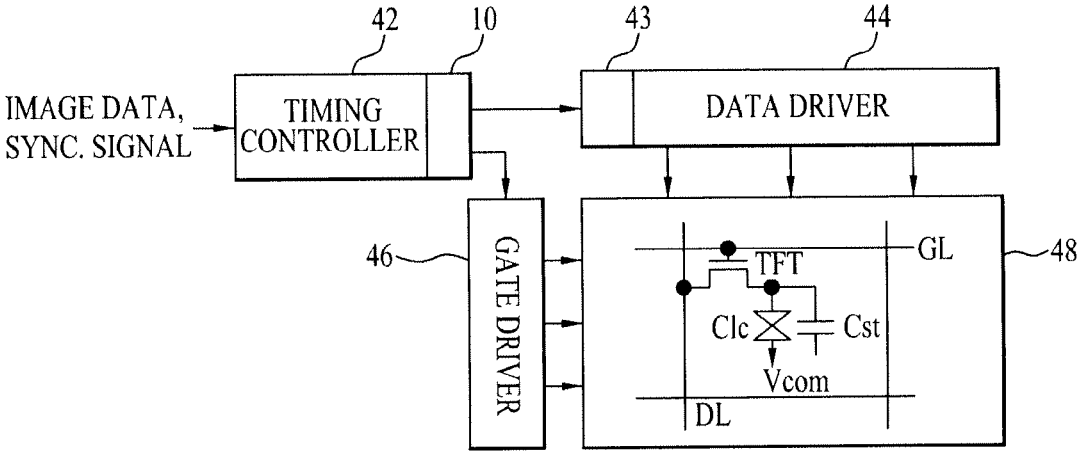
FIG. 3 is a block diagram illustrating a liquid crystal display using the data transmitting device according to the present invention.

FIG. 3 is a block diagram schematically illustrating a liquid crystal display using the data transmitting device according to the present invention.

The liquid crystal display shown in FIG. 3 includes a timing controller 42, a data driver 44, a gate driver 46 and a liquid crystal panel 48. Here, the timing controller 42 has the LVDS transmitter 10 shown in FIG. 1 or 2 mounted therein and the data driver 44 has the LVDS receiver mounted therein, such that data may be transmitted based on mini-LVDS.

The timing controller 42 makes video data inputted outside in alignment and it outputs the aligned input video data to the data driver 44. in addition, the timing controller 42 generates a data control signal controlling a driving timing of the data driver 44 and a gate control signal controlling a driving timing of the gate driver 46, using synchronizing signals including vertical synchronizing signals and horizontal synchronizing signals, data enable signals, dot clocks, only to output the data control signal and the gate control signal to the data driver 44 and the data driver 46, respectively. Especially, the timing controller 43 has the LVDS transmitter 10 shown in FIG. 1 or 2 mounted in an output terminal thereof to convert the image data and the data control signal into low voltage differential signals and to output the converted low voltage differential signals to the data driver 44. In case of using the LVDS transmitter 10 shown in FIG. 1, at least one of the first current (I1*a*) of the reference voltage generator 12 and the second current (I1*b*) of the current generator 14 may be controlled and the output current of the line driver 18 may be controlled accordingly. As a result, the swing of the low voltage differential signal may be controllable. At this time, even if the first current (I1*a*) is not generated in the reference voltage generator 12 because of contact error of the variable resistance (R1), the line driver 18 generates a differential signal by using the second current (I1*b*) generated from the current generator 14 and it outputs the generated differential signal. In addition, the current control signal (ISOD) is controlled to control the output current (I2) of the line driver 18 and the swing of the low voltage differential signal may be controllable accordingly. Alternatively, in case of using the LVDS transmitter 10 relieved of the option pin (RMLVDS) and the variable resistance (R1) as shown in FIG. 2, n-bit current control signal (ISOD) inputted to the current generator 14 may be controlled to control the second current (I1*b*) and the output current (I2) of the line driver 18 may be controlled. As a result, the swing of the low voltage differential signal may be controllable stably. In this case, the option pin (RMLVDS) and the variable resistance (R1) are removed from the timing controller 42 and the production cost may be reduced accordingly.

The data driver 44 has the LVDS receiver 20 mounted in an input terminal thereof and it restores the image data and the data control signal based on voltage difference of the differential signals received from the timing controller 42. in response to the data control signal received from the timing controller 42, the data driver 44 converts digital image data received from the timing controller 44 into an analog data signal (pixel voltage signal) using a gamma voltage and it supplies the converted analog data signal to data lines (DL) of the liquid crystal panel 48.

The gate driver 26 sequentially drives gate lines (GL) of the liquid crystal panel 48 in response to the gate control signal supplied from the timing controller 42. The gate driver 46 may be mounted in the liquid crystal panel 48.

The liquid crystal panel 48 displays images via a pixel matrix having plural pixels aligned therein. Each of the pixels represents a desired color combined with red, green and blue sub-pixels controlling light transmissivity based on variety of liquid crystal alignment according to a brightness-compensated data signal. Each of the sub-pixels includes a thin film transistor (TFT) connected with the gate lines (GL) and the data lines (DL0, a liquid crystal capacitor (C1*c*) connected with the TFT in parallel and a storage capacitor (Cst). The liquid crystal capacitor (C1*c*) charges a voltage difference between the data signal supplied to the pixel electrode via the TFT and the common voltage (Vcom) supplied to the common electrode and it drives the liquid crystal according to the charged voltage to control light transmissivity. The storage capacitor (Cst) keeps the voltage charged by the liquid capacitor (C1*c*) stably. As a result, the liquid crystal panel 48 displays images according to the data signals by using the lights from a backlight unit (not shown).

In the meanwhile, the embodiment according to the present invention embodies the data transmitting device which is applicable to only the liquid crystal display. However, the data transmitting device according to the present invention may be applicable to all types of flat plate displays, for example, a plasma display panel (PDP) and an organic light emitting diode (OLED) display and the like, using digital data transmission.

According to the present invention, there are following advantageous effects.

First of all, according to the data transmitting device and the flat plate display using the same, at least one of the current of the reference voltage generator and the current of the current generator is controlled to control the swing of the low voltage differential signal outputted from the line driver.

Furthermore, even if currents fail to output from the reference voltage generator because of contact error of the variable resistance, the line driver may generate a low voltage differential signal by using the current of the current generator. Also, since the current of the current generator is controlled, the swing of the low voltage differential signal may be controlled stably. Moreover, since the option pin connected with both the reference voltage generator and the variable resistance are removed, the production cost may be reduced. Since the current of the current generator is controlled, the swing of the low voltage differential signal may be controlled stably.

It will be apparent to those skilled in the art that various modifications and variations can be made in the present invention without departing from the spirit or scope of the inventions. Thus, it is intended that the present invention covers the modifications and variations of this invention provided they come within the scope of the appended claims and their equivalents.

What is claimed is:

1. A data transmitting device comprising:

a transmitter configured to transmit data using a Low Voltage Differential Signal ("LVDS); and a receiver configured to detect the data from the transmitted LVDS, wherein the transmitter comprises:

a reference voltage generator configured to generate and output a reference voltage and a first current;

a current generator comprising a plurality of constant current sources connected in parallel and a plurality of switches connected to output terminals of the constant current sources, respectively, the current generator configured to switch the switches independently according to a preset digital current control signal and adding up the currents supplied from the constant current sources via the tuned-on switches to output as a second current;

a contact node adding and outputting the first current from the reference voltage generator and the second current from the current generator;

a current amplifier configured to amplify and output the added current from the contact node; and a line driver configured to generate and output the LVDS according to the data by using a constant current such as the amplified current of the current amplifier, wherein the line driver comprises:

an input constant current source and an output constant current source configured to generate an identical constant current to the amplified current from the current amplifier; and four switches connected between the input and output constant current sources, wherein the four switches form a current loop together with the couple of the transmission lines, between the transmitter and receiver, and the termination resistance between the transmission lines and are selectively switched according to a high level or a low level of the data to output the LVDS, wherein the receiver configured to detect a voltage of the LVDS at the termination resistance by using a comparator and restore the high-level or low-level of the data.

2. The data transmitting device of claim 1, wherein the switches of the current generator are connected commonly with a node having the currents added-up therein and the switches are switched independently in response to each bit of the current control signal, to control the current outputted from the current generator according to the current control signal.

3. The data transmitting device of claim 1, wherein the swing of the LVDS outputted from the line driver is determined based on the output current of the current generator controlled according to the current control signal.

4. The data transmitting device of claim 1, further comprising:

a variable resistance connected with the reference voltage generator to control the output current of the reference voltage generator outside.

5. The data transmitting device of claim 4, wherein the swing of the LVDS outputted from the line driver is controlled based on the control of at least one of the output current of the current generator and the output current of the reference voltage generator.

6. A flat plate display comprising, the flat plate display comprising:

a timing controller having a transmitter configured to convert image data into an LVDS and to output the converted LVDS; and a data driver having a receiver configured to receive the LVDS from the timing controller and to restore and display the image data from the received LVDS, wherein the transmitter comprises:

a reference voltage generator configured to generate and output a reference voltage and a first current;

a current generator comprising a plurality of constant current sources connected in parallel and a plurality of switches connected to output terminals of the constant current sources, respectively, the current generator configured to switch the switches independently according to a preset digital current control signal and adding up the currents supplied from the constant current sources via the tuned-on switches to output as a second current;

a contact node adding and outputting the first current from the reference voltage generator and the second current from the current generator;

a current amplifier configured to amplify and output the added current from the contact node; and a line driver configured to generate and output the LVDS according to the image data by using a constant current such as the amplified current of the current amplifier, wherein the line driver comprises:

an input constant current source and an output constant current source configured to generate an identical constant current to the amplified current from the current amplifier; and four switches connected between the input and output constant current sources, wherein the four switches form a current loop together with the couple of the transmission lines, between the transmitter and receiver, and the termination resistance between the transmission lines and are selectively switched according to a high level or a low level of the data to output the LVDS, wherein the receiver configured to detect a voltage of the LVDS at the termination resistance by using a comparator and restore the high-level or low-level of the data.

7. The flat plate display of claim 6, wherein the switches of the current generator are connected commonly with a node having the currents added-up therein and the switches are switched independently in response to each bit of the current control signal, to control the current outputted from the current generator according to the current control signal.

8. The flat plate display of claim 6, wherein the swing of the LVDS outputted from the line driver is determined based on the output current of the current generator controlled according to the current control signal.

9. The flat plate display of claim 6, further comprising:

a variable resistance connected with the reference voltage generator to control the output current of the reference voltage generator outside.

10. The flat plate display of claim 9, wherein the swing of the LVDS outputted from the line driver is controlled based on the control of at least one of the output current of the current generator and the output current of the reference voltage generator.

11. The flat plate display of claim 6, wherein the flat plate display is a liquid crystal display or an organic light emitting diode display.

* * * * *